US008851398B2

(12) United States Patent
Li et al.

(10) Patent No.: US 8,851,398 B2
(45) Date of Patent: Oct. 7, 2014

(54) OVERHEAD SHOWER AND ITS SWITCHING METHOD THEREOF

(75) Inventors: Renzhong Li, Xiamen (CN); Jianmin Chen, Xiamen (CN); Mayang Lai, Xiamen (CN); Huasong Zhou, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 1359 days.

(21) Appl. No.: 12/620,711

(22) Filed: Nov. 18, 2009

(65) Prior Publication Data

US 2011/0114752 A1 May 19, 2011

(51) Int. Cl.

| | |
|---|---|
| ***B05B 3/02*** | (2006.01) |
| ***A62C 31/02*** | (2006.01) |
| ***A62C 31/00*** | (2006.01) |
| ***A62C 37/20*** | (2006.01) |
| ***B05B 1/18*** | (2006.01) |
| ***B05B 1/30*** | (2006.01) |
| ***B05B 15/08*** | (2006.01) |
| ***B05B 1/16*** | (2006.01) |

(52) U.S. Cl.

CPC . *B05B 1/18* (2013.01); *B05B 1/185* (2013.01); *B05B 1/1609* (2013.01)

USPC ..... 239/222.11; 239/395; 239/396; 239/442; 239/447; 239/562; 239/567; 239/579; 239/587.6

(58) Field of Classification Search

USPC ..... 239/222.11, 390, 391, 392, 395, 396, 239/436, 442, 443, 444, 446, 447, 587.1, 239/587.5, 587.6, 569, 579, 562, 567, 548

See application file for complete search history.

(56) References Cited

U.S. PATENT DOCUMENTS

| | | | | |
|---|---|---|---|---|
| 3,623,670 | A * | 11/1971 | Wakeman et al. | 239/428.5 |
| 4,273,289 | A * | 6/1981 | Jette | 239/458 |
| 4,394,969 | A * | 7/1983 | Jette | 239/414 |
| 4,493,343 | A * | 1/1985 | Arnold et al. | 137/625.17 |
| 4,582,253 | A * | 4/1986 | Gerdes | 239/1 |
| 6,619,567 | B1 * | 9/2003 | Ouyoung | 239/441 |
| 6,659,372 | B2 * | 12/2003 | Marsh et al. | 239/560 |
| 7,320,442 | B2 * | 1/2008 | Bosio | 239/569 |
| 7,472,846 | B2 * | 1/2009 | Thomas et al. | 239/587.4 |
| 8,056,836 | B2 * | 11/2011 | Chen et al. | 239/587.5 |
| 2004/0112985 | A1 * | 6/2004 | Malek et al. | 239/445 |
| 2005/0156062 | A1 * | 7/2005 | Thomas et al. | 239/548 |

FOREIGN PATENT DOCUMENTS

CN 101428258 A 5/2009

* cited by examiner

*Primary Examiner* — Jason Boeckmann
*Assistant Examiner* — Steven M Cernoch
(74) *Attorney, Agent, or Firm* — Rabin & Berdo, P.C.

(57) ABSTRACT

An overhead shower comprises a stationary part rotably connected to a rotating part having two water division apertures disposed oppositely left and right, and a cover plate having two movable members disposed left and right, rotably connected inside said rotating part. A switching method comprises: step 1, Push one side of the overhead shower to rotate the rotating part until the top surface of the movable member of said side of the cover plate leans against the stationary part, and until the water division aperture seals and leans against the underside of the movable member of said side of the cover plate, to seal said water division and simultaneously open another water division aperture; step 2, Release the overhead shower, then the rotating part and said movable member of the cover plate attach hermetically under the water pressure, the rotating part will be restored by a spring or gravity.

14 Claims, 7 Drawing Sheets

A-A

OVERHEAD SHOWER AND ITS SWITCHING METHOD THEREOF

FIELD OF THE INVENTION

The present invention relates an overhead shower and its switching method, especially to a switchable watering function overhead shower by rotating manner and its switching method thereof.

BACKGROUND OF THE INVENTION

The conventional structure of switchable watering function by rotating manner, such as the Chinese patent application applied by the present inventor, its application number is CN200810072279.9, which is a rotable switching structure of a watering device, comprising a shower housing, a water division member and a watering device, said watering device is fixed under the shower housing, the water division member is sealed and fixed upon said watering device; said water division member has at least two water division apertures for respectively connecting through each watering chambers of different watering functions of the watering device; a movable switching device locates upon the water division member of the shower housing, it goes through the shower housing and fastened with a water supply joint, when the shower housing rotates relative to the movable switching device, the movable switching device will seal some water division apertures of the water division member, while a water division aperture is remained open. The conventional shower disposes a movable switching device in the shower, and by the cooperation of the shower and the movement of the water supply joint, when flaps the shower, then the shower will rotate and tilt, and the movable switching device respectively controls the watering of different water division apertures of the water division member, finally to acquire a switchable watering function shower. However, the conventional shower has such disadvantages: 1. because the selectively sealing of a water division aperture is by pushing the ball, if the ball move irregularly, then the sealing would be inefficient; 2. the length of the sleeve is relatively long, moreover a restoring unit is disposed between the sidewall of the sleeve and the housing, thus the size of the conventional shower is relatively large.

SUMMARY OF THE INVENTION

The present invention provides an overhead shower and its switching method thereof, it overcomes the drawbacks of the conventional shower which is relatively oversize and the sealing is inefficient.

The first technical solution applied by the present invention is:

An overhead shower, comprising:

A stationary part, a through water inlet channel is set inside said housing;

A rotating part, comprising a housing and a water division member, said housing is rotably connected to the stationary part, said housing and water division member are fixed together to form a central chamber which connect through said water inlet channel, said water division member has a pivot joint seat and two through water division apertures oppositely disposed by the left and right side of said pivot joint seat; and A cover plate, comprising a pivot joint member and two movable members oppositely disposed by the left and right of the said pivot joint member, said cover plate locates inside said central chamber and its pivot joint member is pivoted to the pivot joint seat of the water division member, so said cover plate can rotate left and right relative to the pivot joint seat of the water division member, the bottom surface of the two movable members selectively seals the two water division apertures, the top surface of the two movable members has a leaning member which can lean against said stationary part.

In a preferred embodiment, said water division member is disposed with two accommodation seats oppositely by the left and right side of said pivot joint seat, both of the accommodation seats have restoring springs inside, the end of said restoring spring has a locating pin, said locating pin freely goes through said cover plate and leans against said stationary part.

In a preferred embodiment, there are pressing covers mounted on both of the two accommodation seats, said pressing cover has a through hole; said locating pin is a stepped stick which has a thin top stick and a thick bottom stick, the annular stepped surface of said thick bottom stick leans against the underside of said pressing cover by the elastic force of the spring, said thin top stick goes through the through hole of pressing cover.

In a preferred embodiment, said stationary part comprising a joint and a pushing plate fixed under the joint, said joint is hollow and configured as a hollow hole, said pushing plate has a through hole, said hollow hole and through hole are oppositely connected through to form the water inlet channel.

In a preferred embodiment, the middle of said pushing plate is fastened with a triangular block which has face-up apex angle; said housing sleeves joint with said joint and supported on the apex angle of the triangular block of the pushing plate.

In a preferred embodiment, said cover plate has a through assembling hole, the left and right side wall of said assembling hole respectively has a face-up step, the face-up surface of said step is configured as said leaning part; said pushing plate locates in the assembling hole of the cover plate, the left and right sides of said pushing plate is respectively disposed on the two leaning parts of the cover plate, and selectively leans against the two leaning parts.

In a preferred embodiment, the undersides of the two movable members of said pressing cover cooperate with each other to form a face-up V-shaped surface.

In a preferred embodiment, the overhead shower further comprising:

A watering member sealed and fixed in the housing, it has a set of first water outlets, a set of second water outlets surrounding the first water outlets and an annular isolating wall fixed on the top surface of the watering member and locates between the first and second water outlets, the top periphery of said isolating wall is sealed and fixed on the underside of the water division member and configured as the first watering chamber which is connected through one of water division apertures, the outside of said isolating wall cooperates with the housing to form the second watering chamber which is connected through another water division aperture.

In a preferred embodiment, the overhead shower further comprising:

A decoration cover sealed and fixed in the housing and locates under the watering member, said decoration cover has a plurality of water outlets.

The second technical solution applied by the present invention is:

A switching method of an overhead shower, wherein said overhead shower comprising a stationary part, a rotating part rotably connected to said stationary part and a cover plate rotably connected in the rotating part, said rotating part has two water division apertures disposed oppositely by the left and right side, said cover plate has two movable members disposed oppositely by the left and right side; its switching method is:

Step 1. Push one side of the overhead shower to make the rotating part rotate until the top surface of the movable member of said side of the cover plate leans against the stationary part, and until the water division aperture of said side of the rotating part seals and leans against the underside of the movable member of said side of the cover plate, meanwhile said water division is sealed while another water division aperture is opened;

Step 2. Release the overhead shower, then the rotating part and said movable member of the cover plate attach hermetically with each other under the water pressure, the rotating part will replace under the restoring spring or its own gravity.

Compared to the background technique, the present technical solution has such advantages: by rotating the rotating part and the cover plate left and right, the left and right side of the water division aperture will be switchable, so the switching process will be precise and quick, the size of the shower will be reduced, further the shower can replace automatically because of the restoring spring. Since said stationary part comprising a joint and a pushing plate, so it is convenient to assemble the housing. Since said pushing plate is disposed inside the assembling hole of the cove plate, so the size of the shower will be reduced. Since the left and right sides of said pushing plate respectively locates on the two leaning parts of the cover plate and selectively leans against the two leaning parts respectively, so the rotating angle of the cover member and the rotating part can be controlled and the water division aperture will be efficiently sealed by the cover.

BRIEF DESCRIPTION OF THE DRAWINGS

The present invention will become apparent upon the combination of the drawings and the embodiments.

DETAILED DESCRIPTION OF THE EMBODIMENTS

Figure 1:
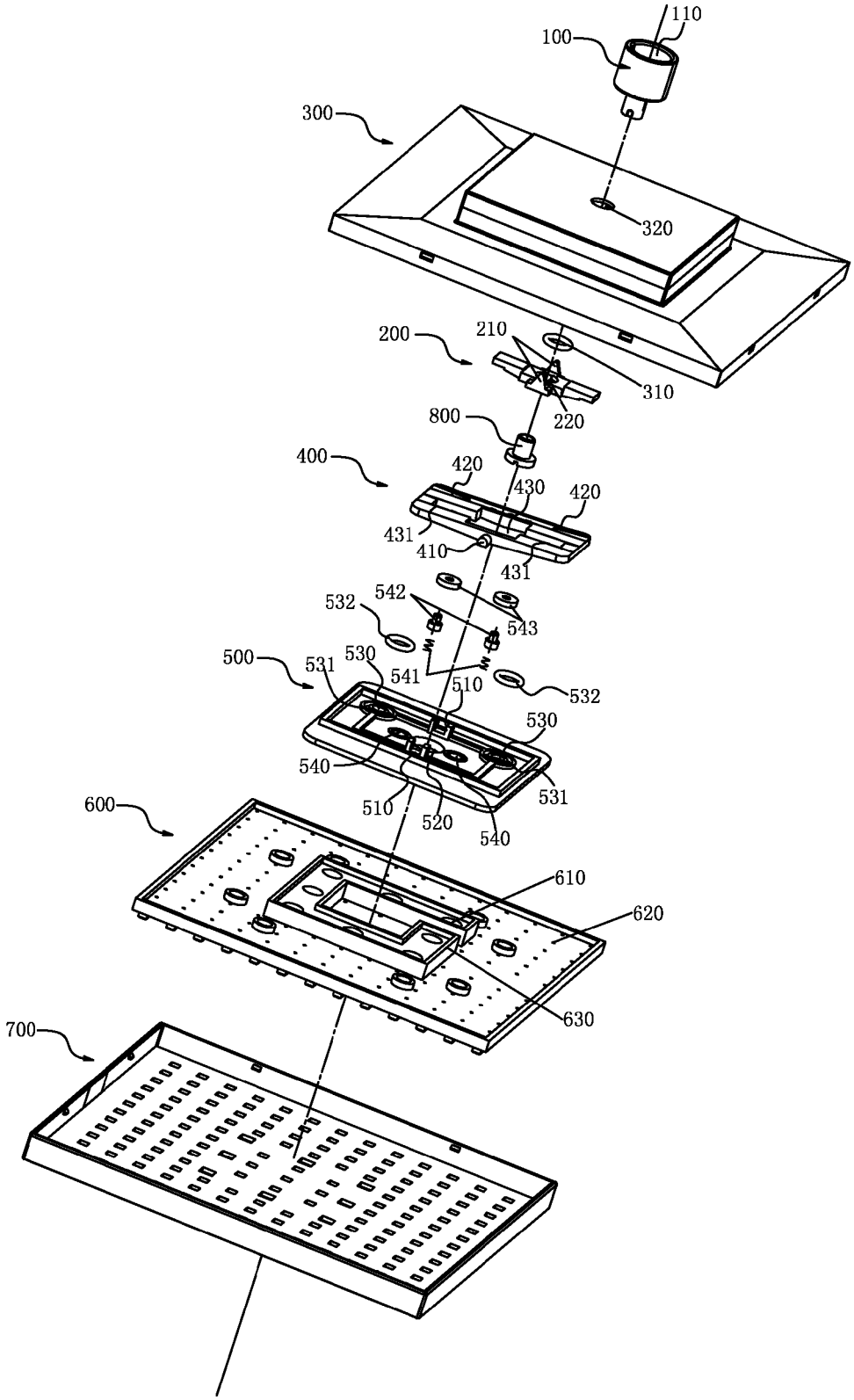
FIG. 1 illustrates the perspective exploded view of the overhead shower of the preferred embodiment.
Figure 2:
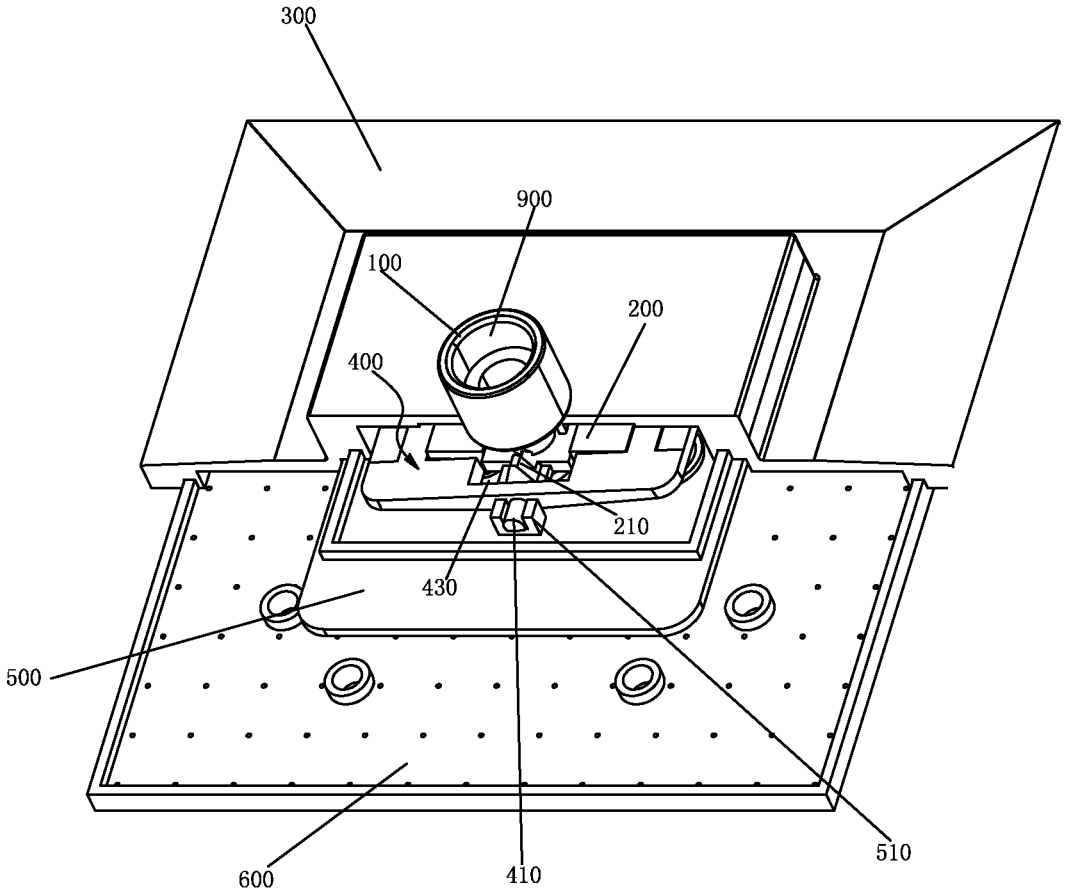
FIG. 2 illustrates the half sectional perspective view of the overhead shower of the preferred embodiment.

Please refer to FIG. 1, FIG. 2, FIG. 3, FIG. 4, FIG. 5 and FIG. 6, an overhead shower, comprising a joint 100, a pushing plate 200, a housing 300, a cover plate 400, a water division member 500, a watering member 600 and a decoration cover 700.

The top of said joint is fixed on the water pipe, said pushing plate 200 fastened under the joint 100 by a hollow screw 800. Said joint 100 is hollow and has a hollow hole 110, said pushing plate 200 is disposed with a through hole 220, said hollow hole and through hole are oppositely connected through to form the water inlet channel 900 which can connect through the water channel. Said joint 100 and pushing plate 200 constitute the stationary part. In the present embodiment, there is respectively a triangular block 210 which has a face-up apex angle and fixed on the front and back of the top surface of the middle of said pushing plate 200 by the left and right.

Figure 6:
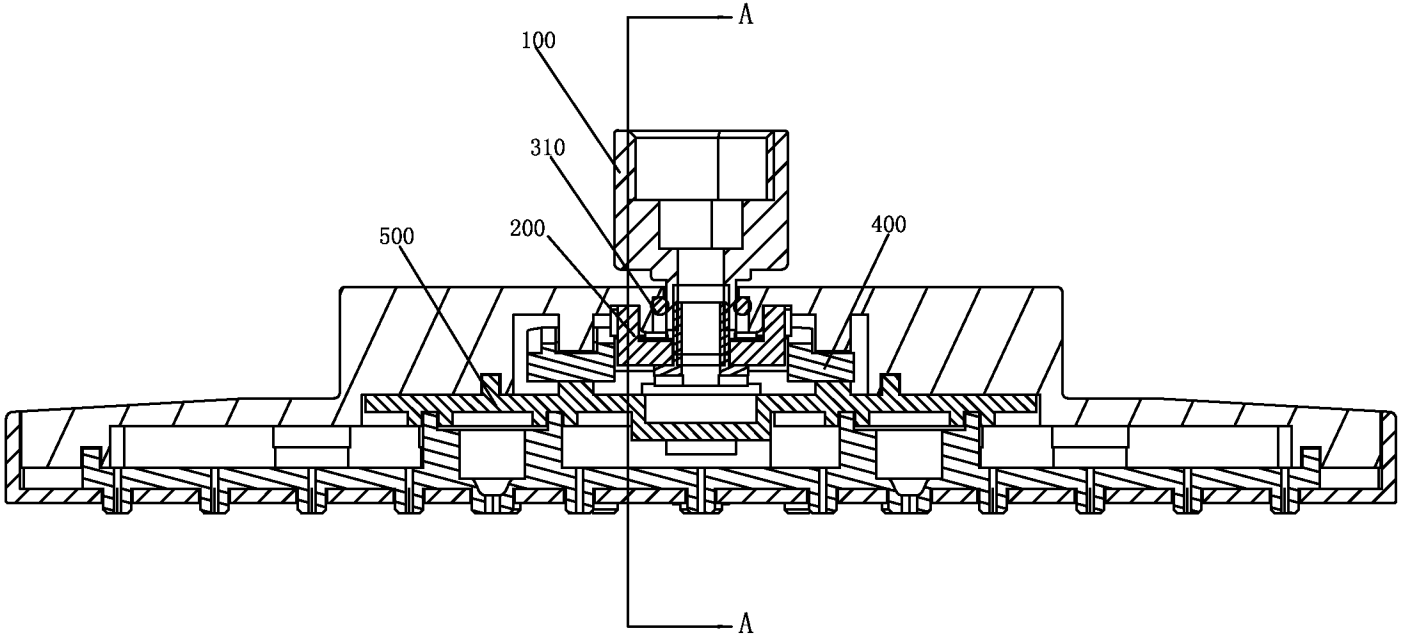
FIG. 6 illustrates the sectional view of the overhead shower of the preferred embodiment.
Figure 7:
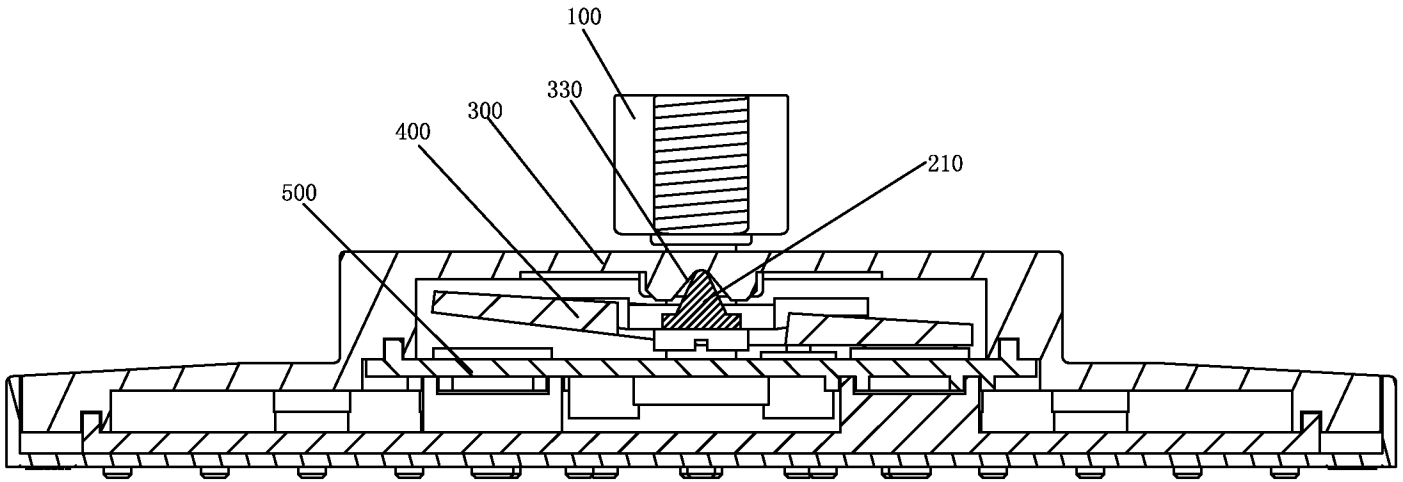
FIG. 7 illustrates the A-A line of the sectional view of FIG. 6.

Please refer to FIG. 1, FIG. 6, said housing 300 comprises a plate, the circumference of said plate extends downwardly to form a top circumferential wall, said top circumferential wall radially extends outwardly to form a annular member and a bottom circumferential wall formed from the downwardly extending of said annular member. Said plate is disposed with V-shaped slot 330 which has a face-down opening beneath, the opening angle of said V-shaped slot 330 is bigger than that of the apex angle of the triangular block (the difference between the angles can be equal to the rotating angle), said V-shaped slot 330 is supported on the apex angle of the two triangle blocks 210 of said pushing plate 200, so said housing 300 can be rotably connected to the stationary part. In the present embodiment, the apex angle of the triangle block 210 supports the housing 300, so the triangular block is not only for supporting, but also for pivoting (by the cooperation of the connecting hole and joint). There is a sealing ring 310 for sealing between the connecting hole of the plate and joint.

Please refer to FIG. 1, FIG. 2, FIG. 3, FIG. 4, said water division member 500 has a housing, a pivot joint seat 510 is respectively fixed by the front and back of the top surface of the middle of the left and right of said housing, the middle of the housing of the water division member 500 has an accommodation groove 520 for spacing the assembly of the stationary part (such as the hollow screw, in order to reduce the height of the shower). Said water division member 500 has two water division apertures 530 disposed oppositely by the left and right of the pivot joint seat 510, the outer circumference of said water division aperture 530 has an annular slot 531 surrounding the opening of the water division aperture 530, the inside of said annular slot 531 is disposed with a sealing ring 532, the free height of said sealing ring 532 is slightly higher than the opening of the water division aperture 530, thus the underside of the movable part 420 of the cover plate 400 only needs to cover the top surface of the sealing ring 532 of one water division aperture 530 in order to seal said water division aperture 530. The application of said structure can ensure the sealing effect, thus simplifies the structure and reduces the dependency on the precision of the spare parts, the manufacturing cost is relatively low. Said water division member 500 has two accommodation seats 540 which are disposed oppositely by the left and right of the pivot joint seat 510, it further has two pressing covers 543 respectively mounted on the two accommodation seats 540, said pressing cover 543 has a through hole. The inside of said accommodation seat 540 has a restoring spring 541, the end of said restoring spring 541 has a locating pin 542, said locating ping 542 is stepped shape and has a thin top stick and a thick bottom stick which are axially superposed (the diameter of said through hole is bigger than that of the thin top stick but smaller than that of thick bottom stick), the circumferential stepped wall of said thick bottom stick leans against the underside of the pressing cover 543 under the elastic force of the spring 541, said thin top stick goes through said through hole of the pressing cover 543.

Please refer to FIG. 1, FIG. 2, FIG. 3, FIG. 4, said water division member 500 is fixed inside the circumferential wall of the housing 300, furthermore, they are mounted together and combined to form a hollow chamber which connects through the water inlet channel 900. In the present embodiment, they are mounted by the following manner: the underside of the circumferential wall of the housing 300 has an annular embedded slot, the top surface near the outer periphery of the housing of said water division member 500 has an annular embedded wall, said annular embedded wall embedded into the annular embedded slot, moreover there is glue at the embedded part, such structure can not only for fastening, but also for sealing.

Please refer to FIG. 1, FIG. 2, FIG. 3, FIG. 4. said cover plate 400 comprising a pivot joint member 410 and two movable members 420 respectively disposed by the left and right of the pivot joint member 410, the underside of the two movable members 420 of said pressing cover 400 cooperate with each other to form a V-shaped surface which has a face-up opening, so the underside of the movable member 420 can parallelly lean against and connect the sealing ring 532 of the water division member 500 after rotating, thus the sealing effect is ensured. The cover plate 400 further has a through assembling hole 43, there are two face-up steps respectively disposed by the left and right of said assembling hole 430, said step surfaces are configured to be the leaning part 431.

Please refer to FIG. 1, FIG. 2, FIG. 3, FIG. 4, said cover plate 400 locates in the hollow chamber and the pivot joint member 410 is pivoted on the pivot joint seat 510 of the water division member 500, so the cover plate 400 can rotate left and right relative to the pivot joint seat 510 of the water division member 500, so the underside of the two movable parts 420 can selectively seal the two water division aperture 530. Furthermore, said pushing plate 200 locates inside the assembling hole 430 of the cover plate 40, the left and right of said pushing plate 200 respectively locates on the two leaning parts 431 of the cover plate 400, and selectively leans against the two leaning parts 431 respectively. Moreover, the projection of said assembling hole 430 surrounds the two accommodation seats 540 of the water division member 500, so the locating pin 542 of the two springs 541 of said water division member 500 can respectively go through the cover plate 400 and lean against the left and right of the pushing plate 200.

Please refer to FIG. 1, FIG. 2, FIG. 3, FIG. 4, the watering member 500 sealed and fixed in the circumferential wall which is beneath the housing 300, said watering member has a set of first water outlets 610, a set of second water outlets 620 surrounding the first water outlets 610 and an annular isolating wall 630 locates between the first water outlets 610 and second water outlets 620, the top periphery of said isolating wall 630 is sealed and fixed on the underside of the water division member 500 and configured as the first watering chamber which is connected through one of water division apertures 530, the outside of said isolating wall 630 cooperates with the housing 300 to form the second watering chamber which is connected through another water division aperture 530.

Please refer to FIG. 1, FIG. 2, FIG. 3, FIG. 4, said decoration cover 700 has a bottom wall and an outer wall, said outer wall sleeves outside of the bottom circumferential wall of the housing, said bottom wall locates under the watering member, said bottom wall has a plurality of water outlets. Said watering member 600 and decoration cover 700 constitute the watering device, said watering device has two chambers of independent watering functions (such as the above mentioned first and second watering chamber) respectively connect through two water division apertures, and the watering units of two different watering functions respectively connect through said two independent chambers.

A switching method of an overhead shower, comprising

Figure 3:
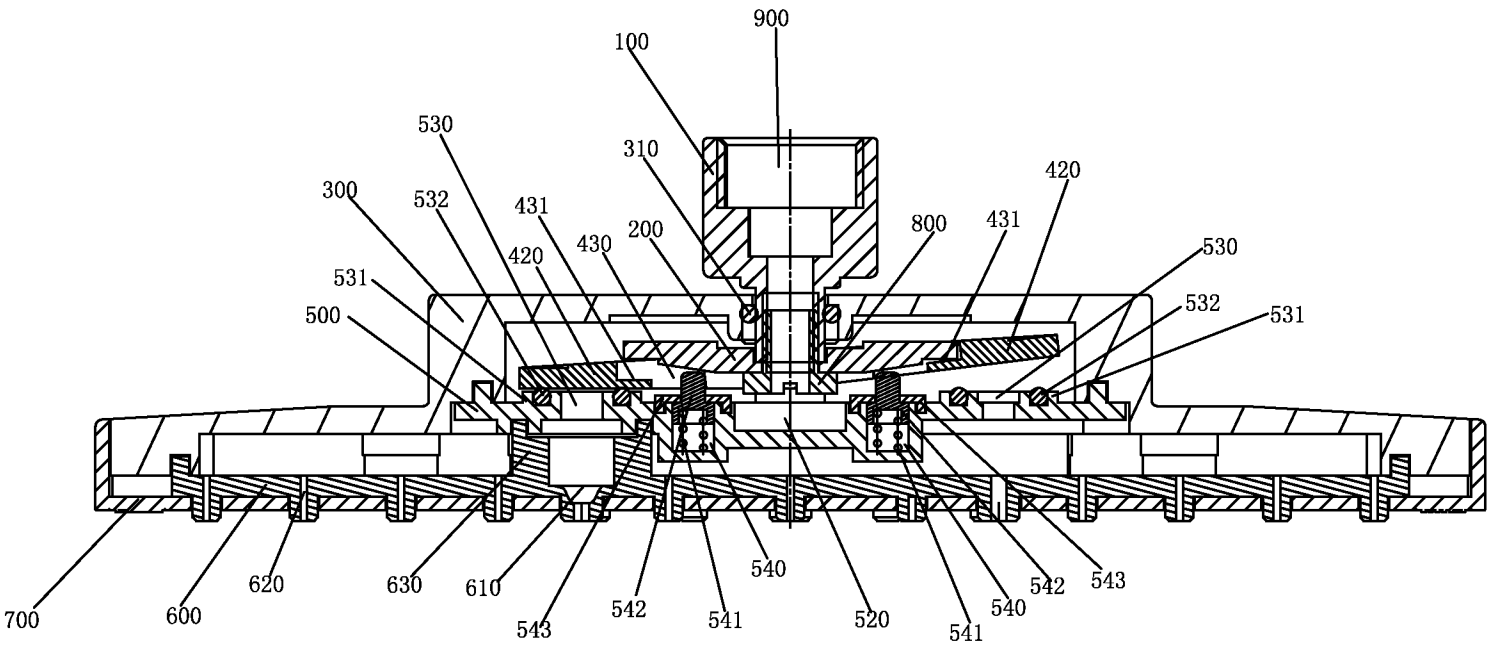
FIG. 3 illustrates a first sectional view of the switching principle of the overhead shower of the preferred embodiment.
Figure 4:
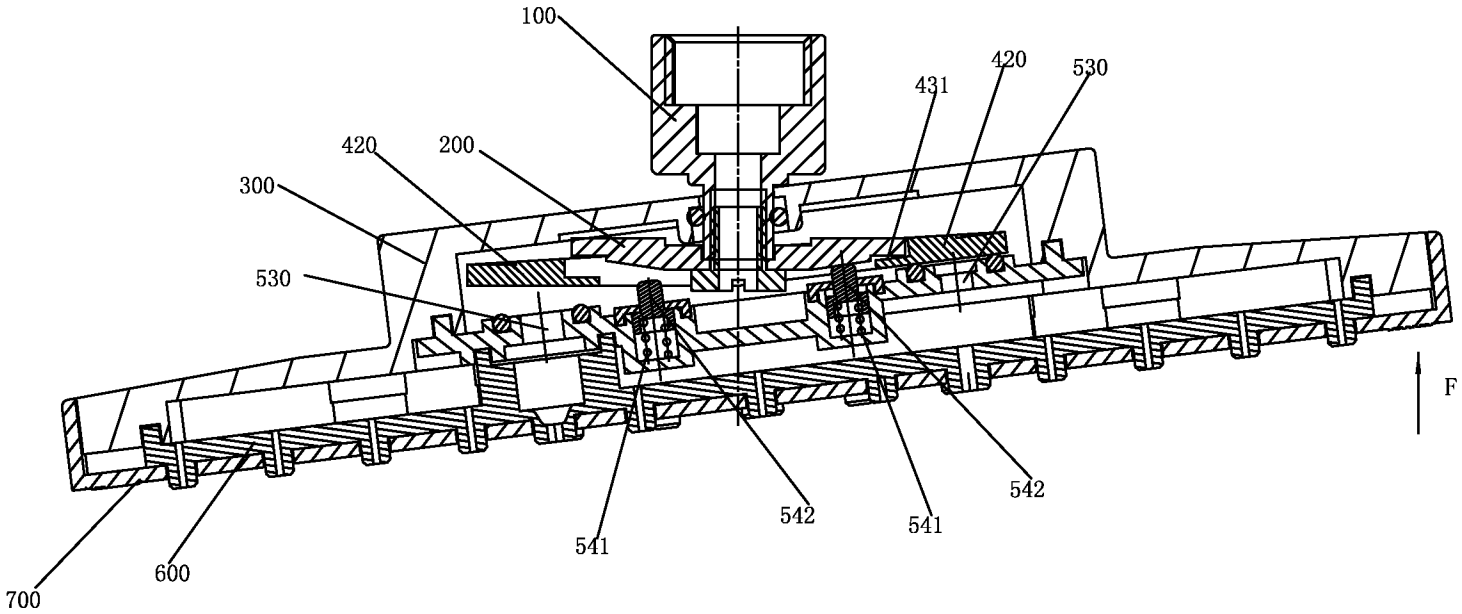
FIG. 4 illustrates a second sectional view of the switching principle of the overhead shower of the preferred embodiment.

Step 1, please refer FIG. 3 and FIG. 4, push one side of the overhead shower to make the rotating part rotate (to overcome the absorbability between of the rotating member and the cover plate), until the top surface of the movable member of said side of the cover plate leans against the stationary part, and until the water division aperture of said side of the rotating part seals and leans against the underside of the moving part of said side of the cover plate, at this moment said water division is sealed while another water division aperture is opened, the spring of said side is compressed for energy storage.

Figure 5:
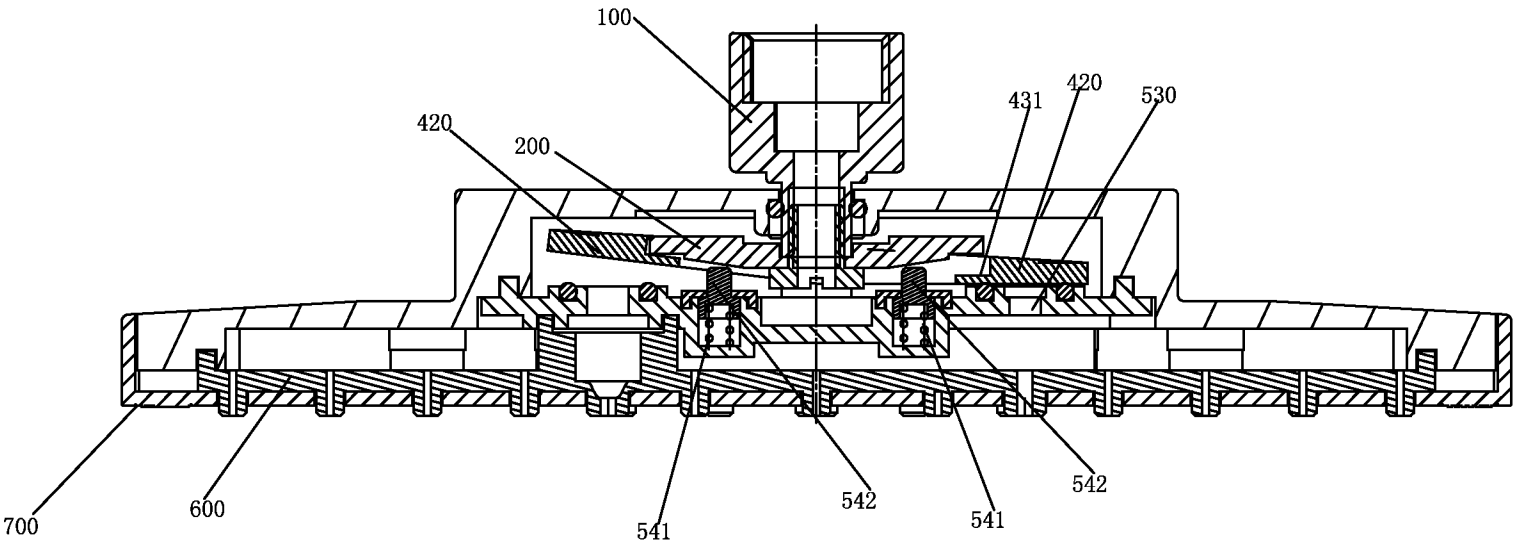
FIG. 5 illustrates a third sectional view of the switching principle of the overhead shower of the preferred embodiment.

Step 2, please refer to FIG. 4 and FIG. 5, release the overhead shower, then the rotating part and said movable member of the cover plate attach hermetically with each other under the water pressure, the rotating part will replace under the restoring spring or its own gravity.

While preferred embodiment of the invention has been described, it will be apparent to those of ordinary skill in the art that many more embodiments and implementations are possible within the scope of this invention. Accordingly, the invention is not to be restricted except in light of the attached claims and their equivalents.

The invention claimed is:

1. An overhead shower, comprising:

a stationary part having a through water inlet channel that is set inside the stationary part, said stationary part including a joint being hollow and having a hollow hole, and a pushing plate fixed under the joint, said pushing plate having a through hole, said hollow hole and said through hole are connected together to form the through water inlet channel, the pushing plate including a triangular block fastened to a middle of said pushing plate, the triangular block having a face-up apex angle; a rotating part including a housing rotatably connected to the stationary part, wherein said housing sleeves said joint and is supported on the apex angle of the triangular block of the pushing plate, and a water division member, said housing and said water division member being fixed together to form a central chamber which connects to said through water inlet channel, said water division member having a pivot joint seat, and two through water division apertures disposed opposite each other so that one of the apertures is on a left side of the pivot joint seat and another of the apertures is on a right side of said pivot joint seat; and a cover plate being located inside said central chamber and including a pivot joint member that pivots on the pivot joint seat of the water division member so that said cover plate is rotatable to both the left and right sides of the pivot joint seat of the water division member, and two movable members disposed opposite each other on left and right sides of said pivot joint member, a bottom surface of the two movable members selectively seals the two through water division apertures, a top surface of the two movable members has a leaning member which is leanable against said stationary part.

2. The overhead shower according to claim 1, wherein said water division member includes restoring springs, locating pins, and two accommodation seats that are disposed opposite each other on the left and right sides of said pivot joint seat, each of the accommodation seats having one of the restoring springs inside, said restoring springs each having an end that has attached thereto one of the locating pins, each of the locating pins freely moving through said cover plate to lean against said stationary part.

3. The overhead shower according to claim 2, wherein said water division member includes pressing covers mounted on both of the two accommodation seats, said pressing covers each having a through hole, each of said locating pins being a stepped stick which has a thin top stick and a thick bottom stick, an annular stepped surface of said thick bottom stick leans against an underside of one of said pressing covers by an elastic force of one of the restoring springs, said thin top stick penetrates through the through hole of the one of said pressing covers.

4. The overhead shower according to claim 1, wherein said cover plate has a through assembling hole, left and right sides of a wall of said through assembling hole each has a face-up step, each of said steps having a face-up surface configured as said leaning member so that the leaning member includes two leaning parts, wherein said pushing plate is located in the through assembling hole of the cover plate, left and right sides of said pushing plate are respectively disposed over the two leaning parts of the cover plate, and the pushing plate selectively leans against the two leaning parts.

5. The overhead shower according to claim 3, wherein undersides of the two movable members of said cover plate cooperate with each other to form a face-up V-shaped surface.

6. The overhead shower according to claim 1, further comprising:

a watering member sealed and fixed in the housing, the watering member having a set of first water outlets, a set of second water outlets surrounding the first water outlets, and an annular isolating wall fixed on a top surface of the watering member and located between the first and second sets of water outlets, a top periphery of said isolating wall is sealed and fixed on an underside of the water division member and forms a first watering chamber which is connected to one of the water division apertures, an outside of said isolating wall cooperates with the housing to form a second watering chamber which is connected to another of the water division apertures.

7. The overhead shower according to claim 6, further comprising a decoration cover sealed and fixed to the housing and located under the watering member, said decoration cover having a plurality of water outlets.

8. The overhead shower according to claim 5, wherein said cover plate has a through assembling hole, left and right sides of a wall of said through assembling hole each has a face-up step, each of said steps having a face-up surface configured as said leaning member so that the leaning member includes two leaning parts, wherein said pushing plate is located in the through assembling hole of the cover plate, left and right sides of said pushing plate are respectively disposed over the two leaning parts of the cover plate, and the pushing plate selectively leans against the two leaning parts.

9. The overhead shower according to claim 6, wherein said cover plate has a through assembling hole, left and right sides of a wall of said through assembling hole each has a face-up step, each of said steps having a face-up surface configured as said leaning member so that the leaning member includes two leaning parts, wherein said pushing plate is located in the through assembling hole of the cover plate, left and right sides of said pushing plate are respectively disposed over the two leaning parts of the cover plate, and the pushing plate selectively leans against the two leaning parts.

10. The overhead shower according to claim 1, wherein undersides of the two movable members of said cover plate cooperate with each other to form a face-up V-shaped surface.

11. The overhead shower according to claim 2, further comprising:

a watering member sealed and fixed in the housing, the watering member having a set of first water outlets, a set of second water outlets surrounding the first water outlets, and an annular isolating wall fixed on a top surface of the watering member and located between the first and second sets of water outlets, a top periphery of said isolating wall is sealed and fixed on an underside of the water division member and forms a first watering chamber which is connected to one of the water division apertures, an outside of said isolating wall cooperates with the housing to form a second watering chamber which is connected to another of the water division apertures.

12. The overhead shower according to claim 3, further comprising:

a watering member sealed and fixed in the housing, the watering member having a set of first water outlets, a set of second water outlets surrounding the first water outlets, and an annular isolating wall fixed on a top surface of the watering member and located between the first and second sets of water outlets, a top periphery of said isolating wall is sealed and fixed on an underside of the water division member and forms a first watering chamber which is connected to one of the water division apertures, an outside of said isolating wall cooperates with the housing to form a second watering chamber which is connected to another of the water division apertures.

13. The overhead shower according to claim 11, further comprising a decoration cover sealed and fixed to the housing and located under the watering member, said decoration cover having a plurality of water outlets.

14. The overhead shower according to claim 12, further comprising a decoration cover sealed and fixed to the housing and located under the watering member, said decoration cover having a plurality of water outlets.

* * * * *